US008123051B2

(12) United States Patent
Johnson et al.

(10) Patent No.: US 8,123,051 B2
(45) Date of Patent: Feb. 28, 2012

(54) DISPLAY APPARATUS FOR SECURELY DISPLAYING A PRODUCT

(75) Inventors: Jason W. Johnson, Minneapolis, MN (US); Sixto Beltrandy, Minneapolis, MN (US); Joseph R. Guggenberger, Elk River, MN (US)

(73) Assignee: Target Brands, Inc., Minneapolis, MN (US)

( * ) Notice: Subject to any disclaimer, the term of this patent is extended or adjusted under 35 U.S.C. 154(b) by 345 days.

(21) Appl. No.: 12/505,964

(22) Filed: Jul. 20, 2009

(65) Prior Publication Data

US 2011/0011812 A1 Jan. 20, 2011

(51) Int. Cl.
*A47F 5/08* (2006.01)

(52) U.S. Cl. ..... 211/87.01

(58) Field of Classification Search ..... 211/87.01, 211/86.01, 89.01, 60.1; 248/316.3, 316.4, 248/441.1, 444.1, 451
See application file for complete search history.

(56) References Cited

U.S. PATENT DOCUMENTS

| | | | | | |
|---|---|---|---|---|---|
| 1,053,114 | A * | 2/1913 | Seaberg | 40/766 |
| 2,029,091 | A * | 1/1936 | Bern | 40/739 |
| 2,662,333 | A * | 12/1953 | Bargen | 248/455 |
| 3,091,011 | A * | 5/1963 | Campbell | 280/814 |
| 3,836,058 | A * | 9/1974 | Penniman et al. | 224/315 |
| 3,870,153 | A * | 3/1975 | Allsop et al. | 211/37 |
| 4,108,312 | A * | 8/1978 | Craven | 211/85.7 |
| 4,436,271 | A * | 3/1984 | Manso | 248/460 |
| 4,466,601 | A * | 8/1984 | Raines | 269/79 |
| 4,763,797 | A * | 8/1988 | Egan | 211/70.5 |
| 5,024,408 | A * | 6/1991 | Magee | 248/206.5 |
| 5,141,116 | A * | 8/1992 | Mojica | 211/60.1 |
| 5,183,164 | A * | 2/1993 | Heinzle | 211/70.5 |
| 5,390,837 | A * | 2/1995 | Ruffolo, Jr. | 224/482 |
| 5,477,968 | A | 12/1995 | Largent | |
| 5,580,024 | A * | 12/1996 | Briee | 248/444 |
| 5,601,196 | A * | 2/1997 | Heer et al. | 211/65 |
| 5,788,202 | A * | 8/1998 | Richter | 248/316.4 |
| 5,799,915 | A * | 9/1998 | Morey | 248/201 |
| 5,810,316 | A * | 9/1998 | Eby | 248/451 |
| 5,826,908 | A * | 10/1998 | McBride | 280/814 |
| 5,855,329 | A * | 1/1999 | Pagano | 248/451 |
| 5,979,855 | A * | 11/1999 | Maier | 248/441.1 |
| 6,196,397 | B1 | 3/2001 | Maher | |
| 6,454,106 | B1 * | 9/2002 | Howard | 211/50 |
| 6,640,978 | B2 * | 11/2003 | Reiser et al. | 211/4 |
| 6,695,154 | B2 | 2/2004 | Jacobs | |
| 6,827,226 | B2 | 12/2004 | Coulson | |
| D554,391 | S | 11/2007 | Kostigian | |
| 7,374,051 | B2 * | 5/2008 | Garceau | 211/63 |
| 7,896,175 | B1 * | 3/2011 | Corr et al. | 211/86.01 |
| 2003/0196973 | A1 * | 10/2003 | Jacobs | 211/85.7 |
| 2007/0125731 | A1 | 6/2007 | Waterman | |

* cited by examiner

*Primary Examiner* — Sarah Purol
(74) *Attorney, Agent, or Firm* — Griffiths & Seaton PLLC

(57) ABSTRACT

Some embodiments of a display fixture may include an articulable arm assembly that can be adjusted so as to retain items in a vertical orientation. In one implementation, the arm assembly may be mounted to a horizontal cross-member of a retail display fixture and may include two grasping arms that can be slidably adjusted relative to one another so as to contact the edges of a surfboard or wakeboard and securely display the item in an offset orientation such that the item is presented at an angle relative to a normal viewing direction. The arm assembly may include a pivot mechanism that permits the angle to be adjusted, optionally to a number of predetermined angular positions.

24 Claims, 6 Drawing Sheets

DISPLAY APPARATUS FOR SECURELY DISPLAYING A PRODUCT

BACKGROUND

Display fixtures can be used in retail stores or other environments to present various products to consumers. The display fixtures may retain products for consumers to purchase, or display products or images of products for consumers to view. For example, shirts, pants, and other various apparel products may be suspended from a display fixture. Such a display fixture can be arranged along an aisle in a store so that consumers walking by the display fixture can view selected products.

In another example, sporting goods, such as baseball bats, rollerblades, bicycle helmets, and hockey sticks can be hung from hooks or hangers attached to a retail display shelf Consumers may select among various styles and sizes of the sporting goods to find a desired product. Consumers can remove a desired sporting good product from the retail display and purchase the product.

In some circumstances, a retail display can display various sample products that are not available for purchase as examples of other products that are available for purchase. For example, a retail display may include a number of mannequins for displaying a variety of apparel items. The apparel items worn by the mannequins may not be for sale, but other products of the same style as the apparel items worn by the mannequins may be available for purchase. As another example, a retail case may display a variety of screws of various sizes. The screws within the case may not be available for purchase, but screws of the same size and design as the screws within the case may be available for purchase in a nearby bin or rack.

As another example, a retail display may include a number of fixtures for displaying kayaks or canoes. Such fixtures may retain display units of the kayaks or canoes out of reach of customers, in which case additional units would ordinarily be retrieved from an associated warehousing area in the event of a purchase. Other versions of such fixtures include horizontally extending arms that support the underside of the kayaks and canoes. The arms essentially provide a horizontal rack on which the kayaks or canoes rest. In such retail environments the displayed unit may itself be made available for sale.

Another type of fixture is typically used to display surfboards or skis. Such fixtures may comprise posts or arms extending outwardly from a wall, the posts being spaced apart a suitable distance to permit surfboards or skis to be inserted between the post and leaned against the wall or the posts. With these display arrangements customers may interact directly with the merchandise and may readily remove the surfboards or skis from the display unit and transport them around the retail environment.

SUMMARY

Some embodiments of a display fixture may include an articulable arm assembly that can be adjusted so as to retain items in a vertical orientation. In one implementation, the arm assembly may be mounted to a horizontal cross-member of a retail display fixture and may include two grasping arms that can be slidably adjusted relative to one another so as to contact the edges of a surfboard or wakeboard and securely display the item in an offset orientation such that the item is presented at an angle relative to a normal viewing direction. The arm assembly may include a pivot mechanism that permits the angle to be adjusted, optionally to a number of predetermined angular positions. In certain implementations, two or more such arm assemblies may be used to retain lower and upper portions of the surfboard or wakeboard, thereby substantially preventing customers from removing the item from the display and elevating the item so that a bottom surface of the item is not abraded from contact with a floor or base panel of an associated display fixture. In some embodiments, the arm assemblies may be integrated into the same display fixture on which retail display shelves are mounted, wherein the display shelves support products associated with the item being retained by the display fixtures.

In some embodiments, multiple display fixtures may be attached to a retail display shelf to allow several items to be secured and displayed by the display fixtures. For example, several display fixtures may be used to retain and display four surfboards in a side by side fashion relative to each other. As such, a consumer can easily view and compare the surfboards so as to select from among the surfboards. As another example, a first set of display fixtures may be used to retain a surfboard, a second set of display fixtures may be used to retain a wakeboard, and a third set of display fixtures may be used to retain a skateboard. As such, a consumer can easily view and touch the retained items so as to select from among the items without being able to readily remove the items from the display fixture.

In an illustrative embodiment, grasping arms of an arm assembly of a display fixture may include pads on an inner surface for contacting and securing an item. As such, the pads may prevent damage to the surfaces of an item being contacted by the display fixture. In an illustrative embodiment, a first arm of the arm assembly may include an aperture to allow a portion of the second arm of the arm assembly to pass through the first arm. For example, the width of the arm assembly may be adjusted to a width that is less than the width of one arm of the arm assembly by sliding the second arm relative to the first arm so that a portion of the first arm passes through the aperture.

The details of one or more embodiments of the invention are set forth in the accompanying drawings and the description below. Other features, objects, and advantages of the invention will be apparent from the description and drawings, and from the claims.

DETAILED DESCRIPTION OF ILLUSTRATIVE EMBODIMENTS

Figure 1:
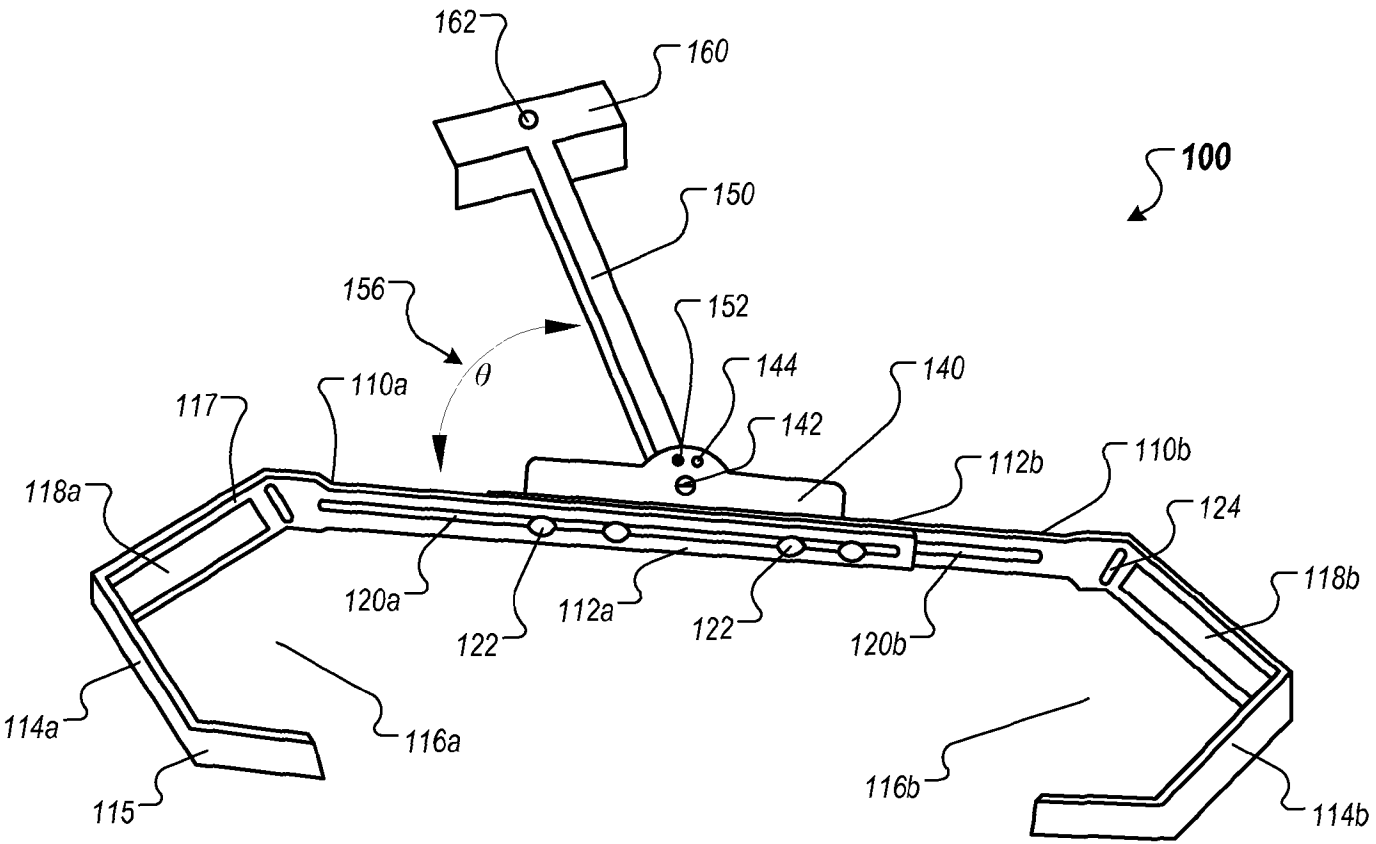
FIG. 1 is a perspective view of a display fixture, in accordance with some embodiments.

Referring to FIG. 1, some embodiments of a display fixture 100 can be configured to secure and display a variety of board shaped products. For example, products secured and displayed by the display fixture 100 can include surfboards, snowboards, skateboards, long boards, wakeboards, and ironing boards. The display fixture 100 includes a support arm 150 which terminates at its proximal end in a support bracket 160. The display fixture 100 further includes a joint bracket 140 attached to the distal end of the support arm 150. The display fixture 100 further includes an arm assembly which includes grasping arms 110*a* and 110*b* and attaches to the joint bracket 140. The arm assembly can be articulated in a lateral direction to adjust the width of the display fixture in order to secure a portion of a product using the grasping arms 110. In some embodiments, the display fixture 100 can display a product (e.g. a surfboard) in a generally vertical manner. In some embodiments, two or more display fixtures can attach to a retail display shelf and can be used to secure and display a product in a generally vertical manner by grasping the edges of the product with the grasping arms 110.

Each grasping arm 110 includes a longitudinally extending portion 112 and a grasping portion 114. In the embodiment shown in FIG. 1, each grasping portion 114 includes a number of linear portions connected so as to form a generally hook shaped portion. Each grasping portion 114 defines a channel 116 for receiving a surfboard or other product as mentioned above. For example, a surfboard can be grasped by the grasping arm 110*a* by positioning the side of the surfboard within the channel 116*a* so that a front portion 115 of the grasping portion 114*a* contacts the front of the surfboard and a back portion 117 of the grasping portion 114*a* contacts the back of the surfboard.

Each grasping arm 110 includes one or more pads 118 on the inner surface of the grasping portion 114. The pads can contact a product that is being secured by the display fixture 100 to secure the product in place while preventing damage to the product. For example, the pads 118 can prevent the grasping arms 110 from scratching a surfboard that is being secured by the display fixture 100.

The grasping arms 110 are slideably mounted to one another to allow the display fixture 100 to be adjusted to the width of a product being secured. For example, the grasping arms 110 can be slid apart with relation to each other to allow a surfboard to be placed between the grasping portions 114 of the grasping arms 110. The grasping arms can be slid together until the grasping portions 114 contact the surfboard, to provide a secure fit. As another example, the display fixture 100 can be adjusted to a first width to display a surfboard. The surfboard can then be removed from the display fixture 100, and the display fixture 100 can be adjusted to a second width, which is smaller than the first width, to secure a smaller product, such as a skateboard.

Still referring to FIG. 1, in accordance with some embodiments, each grasping arm 110 includes a track 120. The tracks 120 are disposed within the longitudinally extending portions 112 of the grasping arms 110. The grasping arms 110 are secured to one another using fasteners (e.g. bolts 122) extending through the track 120 of each grasping arm 110. In some embodiments, rather than the bolts 122, the fasteners can be screws, pins, or rivets. The bolts 122 can be loosened to allow each grasping arm 110 to slide along its respective track 120 in relation to the other grasping arm 110. The bolts 122 can be tightened (for example, using nuts) to secure the display fixture 100 at a particular width. For example, the bolts 122 can extend first through the track 120*a* and then through the track 120*b* and can couple to nuts on the back side of the grasping arm 110*b*. The nuts can be tightened to secure the bolts 122 and hold the grasping arms 110 in place with respect to each other.

In some embodiments, the nuts used to secure the bolts 122 can be wing nuts to allow an employee of a store which includes the display fixture 100 to easily loosen and tighten the nuts by hand without the use of handheld tools. This allows the employee to easily adjust the width of the display fixture 100 to accommodate a variety of products of varying sizes. For example, the employee can easily loosen the nuts and slide the grasping arms 110 away from each other to remove a large product, such as a surfboard. The employee can then insert a smaller product, such as a snowboard, between the grasping portions 114 of the grasping arms 110 and slide the grasping arms 110 toward each other to hold the snowboard in place. The employee can then tighten the wing nuts by hand to secure the snowboard in place.

In some embodiments, the nuts used to secure the bolts 122 can be nuts that require a special tool to be loosened and tightened so that only an employee of the store is capable of loosening the bolts 122 and adjusting the width of the display fixture 100. For example, the nuts can have a unique shape that does not readily mate with a standard wrench. A special tool that is keyed to the unique shape of the nuts can be used to loosen and tighten the nuts. As another example, the bolts 122 can have a unique pattern to prevent standard wrenches and screwdrivers from being used to loosen and tighten the bolts 122. A special tool that matches the unique pattern of the bolts 122 can be used to loosen and tighten the nuts. This allows the display fixture 100 to securely retain a product while preventing customers from removing the product from the display fixture 100. In some embodiments, the nuts used to tighten the bolts 122 can be partially hidden from view so as not to be readily noticeable by a customer viewing the display fixture 100. This can prevent a customer from loosening the bolts 122 and releasing a product from the display fixture 100.

In some embodiments, the grasping arm 110*b* can include one or more spring loaded ball bearings disposed along the longitudinally extending portion 112*b* and the grasping arm 110*a* can include a number of detents at various intervals along the length of the longitudinally extending portion 112*a* for receiving the spring loaded ball bearings. The spring loaded ball bearings can engage the detents to hold the grasping arms 110 at a number of predetermined widths with relation to each other. This provides a quick release sliding mechanism for adjusting the width of the display fixture 100 without the use of nuts, bolts, screws, or tools.

The grasping arm 110*b* includes an aperture 124 to allow the longitudinally extending portion 112*a* of the grasping arm 110*a* to pass through the grasping arm 110*b*. This allows the display fixture 100 to be adjusted to widths that are smaller than the length of a grasping arm 110. For example, if the grasping arm 110*b* did not include the aperture 124, the display fixture 100 would only be able to be decreased in width until the end of the longitudinally extending portion 112*a* came in contact with the grasping portion 114*b* of the grasping arm 110*b*. The aperture 124 allows the longitudinally extending portion 112*a* to pass through the grasping arm 110*b*, thereby allowing the display fixture to secure products with relatively small widths (e.g. widths smaller than the length of one grasping arm 110).

In some embodiments, the grasping arms 110 can be made of stainless steel. Stainless steel provides the advantages of stain, corrosion, and rust resistance while being suitably rigid for securing a product to be displayed. In some embodiments, the grasping arms 110 can be made of a rigid plastic. For example, the grasping arms 110 can be made of high density polyethylene, which has a relatively high intermolecular force and tensile strength compared to other rigid plastics, such as low density polyethylene. As another example, the grasping arms 110 can be made of polypropylene, which is lighter weight than high density polyethylene, yet still rigid enough to adequately secure a product for display.

Still referring to FIG. 1, in accordance with some embodiments, the display fixture 100 includes a joint bracket 140. The grasping arms 110 are secured to the joint bracket 140 by the bolts 122 to allow the grasping arms 110 to slide horizontally with relation to the joint bracket 140. In some embodiments, the grasping arms 110 are secured to the joint bracket 140 by tightening nuts onto the ends of the bolts 122. In some embodiments, the joint bracket 140 can include one or more spring loaded pins on the top surface of the joint bracket 140. Each of the grasping arms 110 can include a plate extending from the top surface of the grasping arm 110 in a direction towards the joint bracket 140. The plates can include apertures for receiving the spring loaded pins of the joint bracket 140. This allows the grasping arms 110 to be positioned at a number of predetermine positions with relation to each other and the joint bracket 140. For example, the grasping arm 110*b* can include a plate that extends rearward from the top of the longitudinally extending portion 112*b* over the top surface of the joint bracket 140. The spring loaded pin disposed within the joint bracket 140 can extend through a first aperture of the plate to hold the grasping arm 110*b* at a first fixed position relative to the joint bracket 140. To adjust the position of the grasping arm 110*b*, the pin can be pushed down, and the grasping arm 110*b* can be slid relative to the joint bracket 140 until a second aperture is aligned with the pin. The spring mechanism of the pin can then cause the pin to extend through the second aperture to hold the grasping arm 110*b* at a second fixed position relative to the joint bracket 140.

In accordance with some embodiments, the joint bracket 140 attaches to the support arm 150 at a distal end of the support arm 150. In some embodiments, the joint bracket 140 attaches to the support arm 150 using a bolt 142. In some embodiments, the joint bracket 140 attaches to the support arm using a pin or screw. In some embodiments, the joint bracket 140 can be welded to the support arm 150.

In some embodiments, the joint bracket 140 is capable of rotating or pivoting with relation to the support arm 150. For example, the joint bracket 140 can rotate about the bolt 142 in order to rotate with relation to the support arm 150. In some embodiments, the joint bracket 140 can be coupled to the support arm 150 by a ball bearing mechanism to allow for easy rotation of the joint bracket 140 with relation to the support arm 150.

Still referring to FIG. 1, in some embodiments, the joint bracket 140 includes a number of apertures 144 for receiving a spring loaded pin 152. The spring loaded pin 152 is disposed within the support arm 150. The spring loaded pin 152 can extend through the apertures 144 to hold the joint bracket 140 at a number of predetermined angles with respect to the support arm 150. For example, the spring loaded pin 152 can extend through a first one of the apertures 144 to hold the joint bracket 140 at a first angle with respect to the support arm 150. The spring loaded pin 152 can be pressed down through the first aperture 144 to release the joint bracket 140 and allow the joint bracket 140 to rotate with respect to the support arm 150 about the bolt 142. The joint bracket 140 can be rotated until the spring loaded pin 152 is aligned with a second one of the apertures 144. The spring loaded pin 152 can extend through the second aperture 144 to hold the joint bracket 140 at a second angle with respect to the support arm 150 which is different from the first angle. In some embodiments, the spring loaded pin 152 can hold the joint bracket 140 in a position with relation to the support arm 150 so as to cause the longitudinally extending portion 112*a* to form an angle 156 with respect to the support arm 150. In some embodiments, the angle 156 can be about 50 to 80 degrees. In some embodiments, the angle 156 can be about 60 to 75 degrees. In some further embodiments, the angle 156 can be about 65 to 70 degrees. In some further embodiments, the angle 156 can be about 67 to 68 degrees. In some embodiments, the angle 156 can be about 67.5 degrees. In some embodiments, the angle 156 can be about 30 to 60 degrees. In some embodiments, the angle 156 can be about 40 to 50 degrees. In some further embodiments, the angle 156 can be about 46 to 47 degrees. In some embodiments, the angle 156 can be about 45 degrees.

In some embodiments, the support arm 150 includes one or more spring loaded ball bearings and the joint bracket 140 includes a number of detents for receiving the ball bearings. The detents can receive the one or more spring loaded ball bearings to releasably hold the joint bracket at a desired angle with respect to the support arm. The detents can be spaced apart so as to allow the joint bracket 140 to be positioned at a number of predetermined angles with respect to the support arm 150. In some embodiments, the joint bracket 140 can be rotated to a desired angle with respect to the support arm 150 and secured in place by tightening the bolt 142 (e.g. using a wing nut). In some embodiments, the joint bracket 140 can be secured to the support arm 150 at a fixed angle. For example, the joint bracket 140 can be welded to the support arm 150 at a fixed angle. As another example, a number of fasteners (e.g., nuts and bolts) can be used to attach the joint bracket 140 to the support arm 150 at a fixed angle.

The proximal end of the support arm 150 terminates in the support bracket 160 configured to attach to a support structure. For example, the support bracket 160 can attach to a crossbeam of a retail display shelf. The support bracket includes an aperture 162 for receiving a bolt for securing the display fixture 100 to a support structure. For example, the support bracket 160 can be attached to a crossbeam of a retail display shelf by aligning the aperture 162 with a hole in the crossbeam and inserting a bolt through the aperture 162 and the hole in the crossbeam. A nut can be affixed to the bottom end of the bolt and tightened to hold the display fixture 100 in place with respect to the crossbeam.

Figure 2:
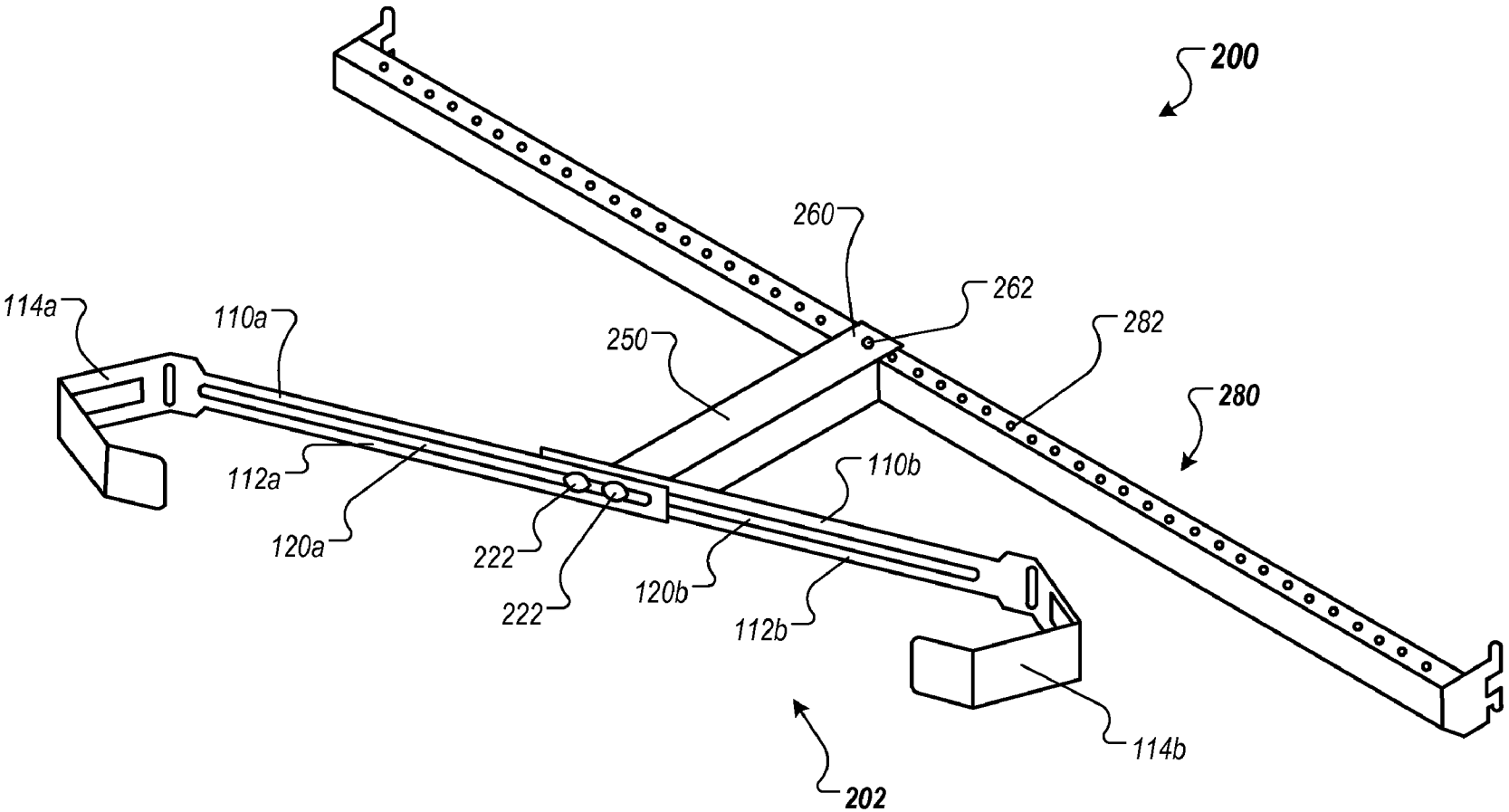
FIG. 2 is a perspective view of a display fixture, in accordance with some embodiments.

Referring to FIG. 2, a merchandise display 200 includes a display fixture 202 and a crossbeam 280. The display fixture 202 includes grasping arms 110*a* and 110*b* as described above with reference to FIG. 1. The display fixture 202 further includes a support arm 250 for attaching the grasping arms 110 to the crossbeam 280. In the example depicted, the support arm 250 attaches directly to the grasping arms 110 without the use of a joint bracket. The grasping arms 110 are secured to the support arm 250 by fasteners (e.g. bolts 222). The bolts are inserted through the tracks 120 of the grasping arms 110 and through bolt receiving apertures of the support arm 250. The bolts 222 can be secured in place by affixing nuts to the bolts 222 to secure the grasping arms 110 in place with respect to the support arm 250. The bolts 222 can be loosened to allow the grasping arms 110 to slide in a horizontal direction with respect to each other and the support arm 250. The bolts 222 can be tightened to hold the grasping arms 110 in a fixed position with relation to each other and the support arm 250.

In some embodiments, the grasping arm 110*b* is attached to the support arm in a fixed position. For example, the grasping arm 110*b* can be permanently fixed to the support arm 250 by welding the longitudinally extending portion 112*b* to the support arm 250. As another example, the grasping arm 110*b* and the support arm 250 can be constructed from a single piece of metal. As another example, the grasping arm 110*b* can be secured to the support arm 250 using rivets. In some embodiments, the support arm 110*a* can be slidably attached to the support arm 110*b* as described above with reference to FIG. 1. In some embodiments, the support arm 110*a* can be slidably attached to the support arm 110*b* using spring loaded ball bearings and detents as described above with reference to FIG. 1.

Still referring to FIG. 2, the support arm 250 includes a support bracket 260 on an end of the support arm 250 opposite the grasping arms 110. The support bracket 260 includes an aperture 262 for receiving a bolt or screw. The crossbeam 280 includes a plurality of holes 282. The support bracket 260 can be positioned along the crossbeam 280 so that the aperture 262 aligns with one of the holes 282. A bolt can be inserted through the aperture 262 and the hole 282 and secured in place using a nut. The bolt can be removed from the hole 282 and the aperture 262 to allow the display fixture 202 to be repositioned along the length of the crossbeam 280. In some embodiments, the display fixture 202 can be detached from the crossbeam 280 by removing the bolt from the aperture 262 and the hole 282. The display fixture 202 can then be attached to a different crossbeam or another suitable support structure capable of receiving the display fixture 202.

Figure 3:
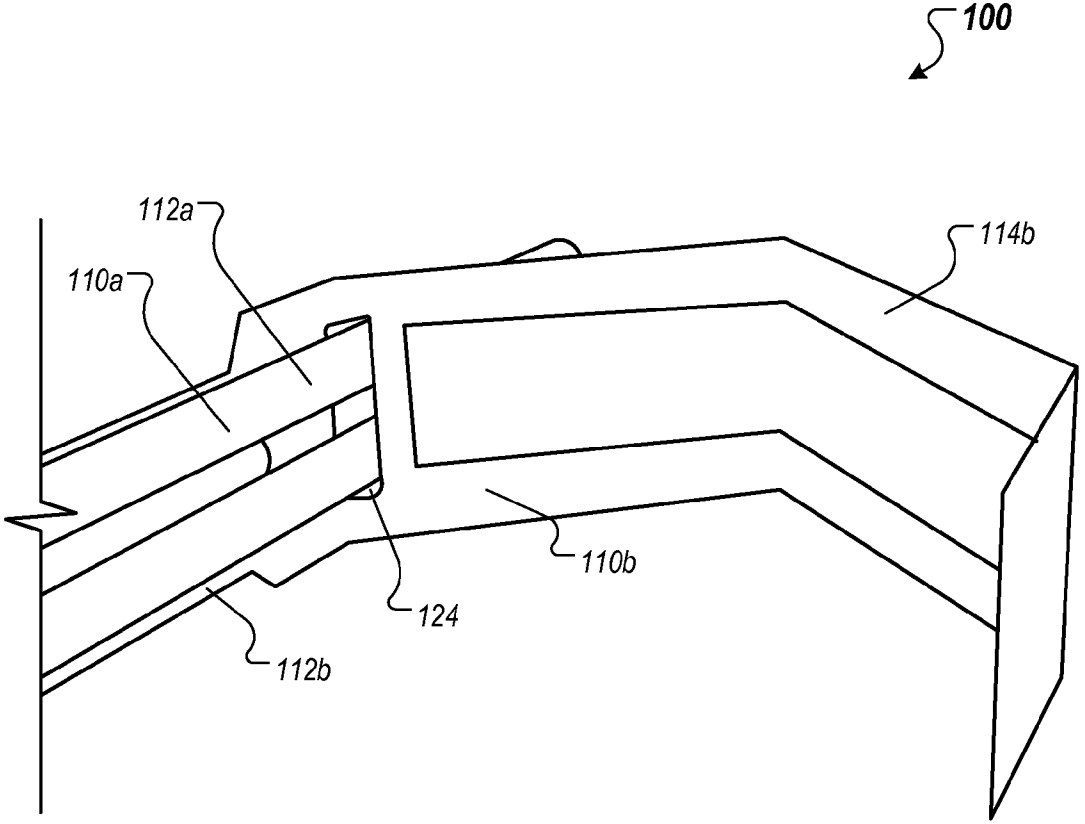
FIG. 3 is a perspective view of a grasping arm of the display fixture of FIG. 1.

Referring to FIG. 3, the longitudinally extending portion 112*a* of grasping arm 110*a* is capable of extending through the aperture 124 of the grasping arm 110*b*. The aperture 124 is wider than the width of the longitudinally extending portion 112*a* to allow the longitudinally extending portion 112*a* to easily pass through. The longitudinally extending portion 112*a* is positioned in front of the longitudinally extending portion 112*b* so that the longitudinally extending portion 112*a* passes through the aperture 124 rather than behind the grasping arm 110. This allows the width of the display fixture 100 to be smaller than the length of a grasping arm 110 (as described above with reference to FIG. 1). In some embodiments, the grasping arm 110*a* can be positioned above or below the grasping arm 110*b* to allow the longitudinally extending portion 112*a* to pass beside the grasping portion 114*b* of the grasping arm 110*b* rather than passing through an aperture in the grasping arm 110*b*.

Figure 4:
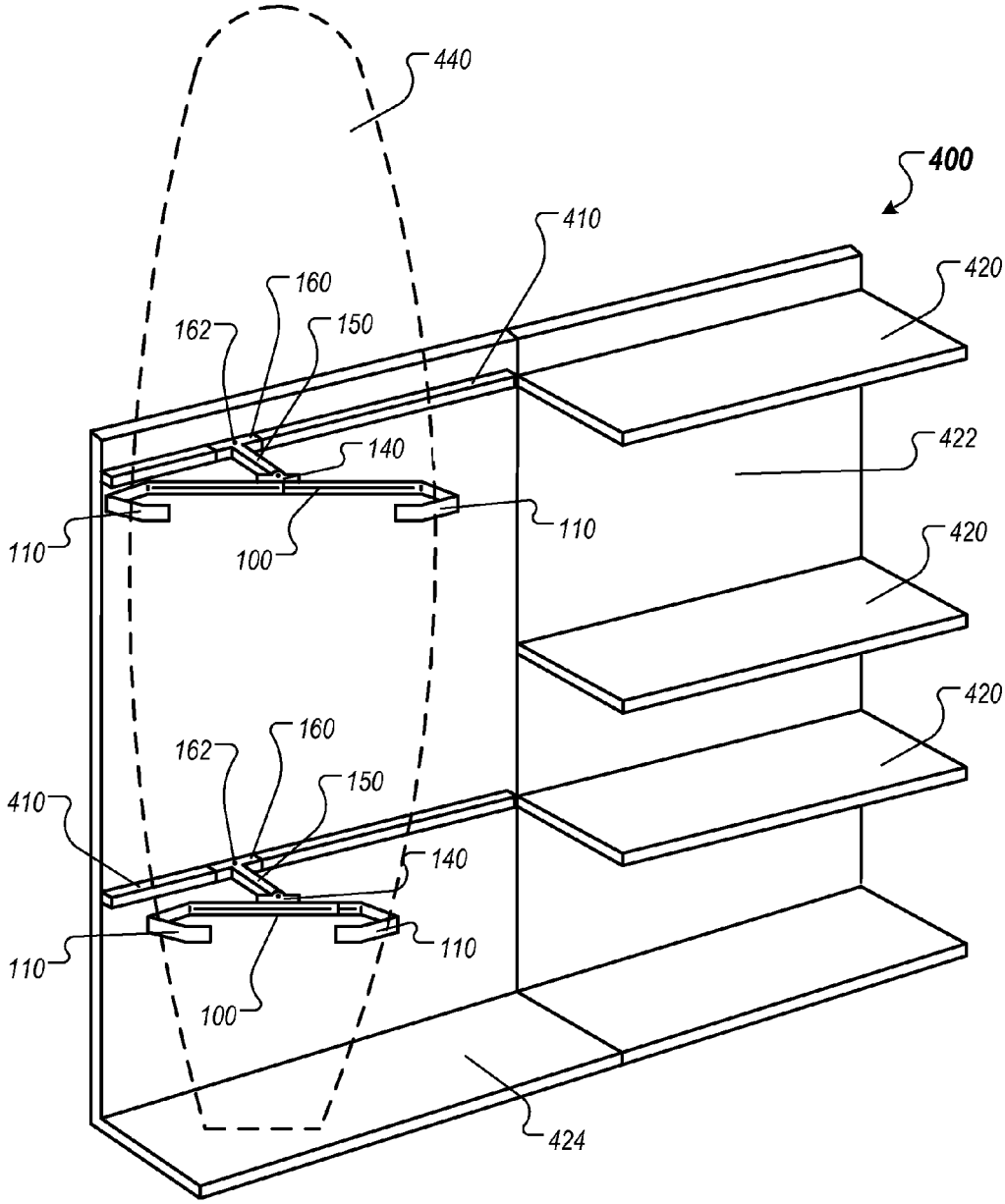
FIG. 4 is a front view of display fixtures securing and displaying a surfboard.

Referring to FIG. 4, in accordance with some embodiments, a product (e.g. a surfboard 440) is secured in place by display fixtures 100. The display fixtures 100 are attached to crossbeams 410 of a merchandise display 400. The display fixtures 100 are attached to the crossbeams 410 by positioning the support brackets 160 on the crossbeams 410 and inserting bolts through the apertures 162 to secure the display fixtures in place. In some embodiments, the merchandise display 400 can include additional display fixtures 100 for receiving additional surfboards or other products as described above with reference to FIG. 1. In some embodiments, the merchandise display 400 can include additional crossbeams 410 for receiving additional display fixtures 100.

In some embodiments, the merchandise display 400 includes a number of shelves 420. The shelves 420 are attached to a back support 422 of the merchandise display 400. Various products can be placed on the shelves 420. For example, products related to surfing, such as wetsuits or sunscreen, can be placed on the shelves 420. In some embodiments, the merchandise display 400 can include a number of hooks for displaying products. For example, the display fixtures 100 can be used to secure a skateboard. Skating related apparel can be hung from the hooks alongside the skateboard. In some embodiments, the merchandise display 400 can include a number of bins for displaying products. Following the example where the display fixtures 100 are used to secure a skateboard, the bins can display skateboard parts such as wheels, bearings, and grip tape.

Still referring to FIG. 4, the surfboard 440 is secured in place by adjusting the grasping arms 110 of the display fixtures 100 to securely contact the edges of the surfboard 440. For example, nuts and bolts of the display fixtures 100 can be loosened to allow the grasping arms to slide horizontally with relation to each other as described above with reference to FIG. 1. Once the grasping arms 110 have been adjusted to a desired position so as to firmly contact the edges of the surfboard 440, the nuts and bolts can be tightened to secure the surfboard 440 in place.

The surfboard 440 can be positioned at a desired angle for display by rotating the joint brackets 140 of the display fixtures 100 with respect to the support arms 150 of the display fixtures as described above with reference to FIG. 1. In some embodiments, the display fixtures 100 can be positioned at a number of predetermined angles for displaying the surfboard at a number of predetermined positions with respect to the merchandise display 400. In some embodiments, the display fixtures 100 can be positioned at any angle within the range of motion of the joint brackets 140 to allow an employee of a store which includes the merchandise display 400 to position the surfboard 440 at a desired angle.

In some embodiments, the bottom of the surfboard 440 is supported by a base portion 424 of the merchandise display 400. The base portion 424 supports a portion of the weight of the surfboard to allow the display fixtures 100 to secure the surfboard 440 in place without bearing the entire weight of the surfboard 440. This can prevent the grasping arms 110 from damaging the edges of the surfboard by allowing the display fixtures 100 to be adjusted to a slightly looser fit. In some embodiments, the surfboard 440 is suspended above the base portion 424 and supported entirely by the display fixtures 100. This can prevent damage to the bottom of the surfboard.

The display fixtures 100 secure surfboard 440 in place to allow customers to see and touch the surfboard 440 without being able to remove the surfboard 440 from the display fixtures 100. This allows a customer to view one or more surfboards 440 and select a desired style or design of surfboard. Securing the surfboard 440 in place prevents the customer from removing from merchandise display 400 and carrying the surfboard 440 through the rest of the store. This can help to prevent damage to other products in the store that can be caused by a customer carrying a large object, such as the surfboard 440, through store isles. If the customer decides to purchase a surfboard, an employee of the store can retrieve a surfboard of the style or design selected by the customer from a storage area, such as a warehouse portion of the store. The customer can pay for the surfboard and pick up the purchased surfboard from a loading dock in order to avoid having to carry a large product through the main portion of the store.

Certain of the aforementioned embodiments have been specifically described in the context of displaying vertically oriented surfboards. The apparatus described herein may be deployed so as to display items in a substantially non-vertical direction, such as at an inclined angle or substantially horizontally. In such embodiments, the arm assemblies may be mounted to horizontal or vertical support rails such that the arm assemblies lie in substantially vertical planes. Alternatively or additionally, a rotational mechanism may be added to the support arm that permits the distal portion to rotate relative to the proximal end. In such embodiments, an axle and bearing assembly may be housed within the outer wall of the support arm such that one end of the axle is retained within each end of the support arm. Frictional engagement members may be placed on the faces of the support arm sections that abut one another to cause the sections to substantially remain in one operative position when not articulated by a user.

In some embodiments, the joint bracket may be rotatably coupled to the support arm to allow the arm assembly to rotate about a major axis of the horizontal arm. For example, the joint bracket may be coupled to the support arm by an axle and bearing assembly such that a first end of the axle is retained within the support arm and a second end of the axel is retained within the joint bracket. In some embodiments, frictional engagement members may be placed on the faces of the support arm and joint bracket that abut one another to cause the sections to substantially remain in one operative position when not articulated by a user.

In some embodiments, the arm assembly can be coupled to the support arm by a lockable universal ball type joint so as to allow the arm assembly to rotate about a plurality of axes with respect to the support arm. For example, the arm assembly may include a generally ball shaped extension which is received by a joint or socket of the support arm, thereby allowing the arm assembly to be positioned at a number of angles within a plurality of planes with respect to the support arm.

In some embodiments, a retail display may include first and second display fixtures. The first display fixture may be positioned above the second display fixture and used to secure an upper portion of a surfboard. The second display fixture may be used to secure a lower portion of the surfboard. The support arm of the first display fixture may be longer than the support arm of the second display fixture so as to position the surfboard so that the front surface of the surfboard is facing in a downward direction relative to vertically displayed surfboard. In some embodiments, the length of the support arm of a display fixture may be adjustable so as to allow an employee of a store which includes the display fixture to adjust the length of the support arm to position a surfboard or other product retained by the display fixture at various angles with respect to a vertically displayed product. For example, the support arm may include a number of telescoping sections nested within each other to allow the length of the support arm to be adjusted.

Figure 5A:
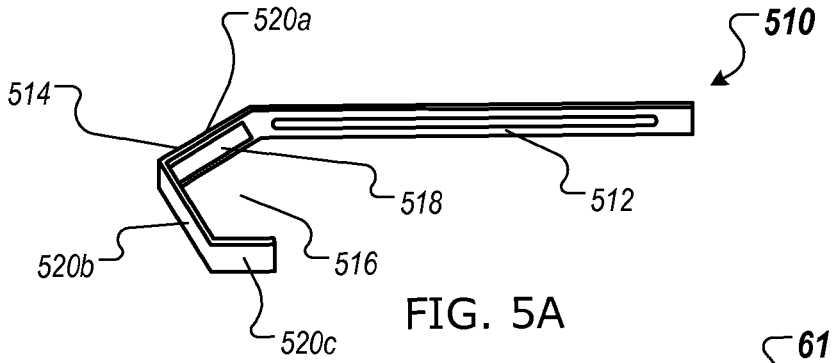
FIGS. 5A-5E show perspective views of grasping arms, in accordance with some embodiments.

Referring to FIG. 5A, in accordance with some embodiments, a grasping arm 510 includes a longitudinally extending portion 512 and a grasping portion 514. The grasping portion 514 is formed from a plurality of straight portions 520*a-c*. The straight portions 520*a-c* of the grasping portion 514 define a channel 516 for receiving an edge of a product, such as a surfboard, snowboard, skateboard, long board, wakeboard, or ironing board. The grasping portion 514 includes one or more pads 518 for receiving the edge of a surfboard or other product as mentioned above. The pads 518 can prevent the grasping portion 514 from damaging a product being secured by the grasping arm 510. In some embodiments, the grasping arm 510 can be made from a soft plastic, such as polypropylene to prevent the grasping portion 514 from damaging a product, thereby eliminating the need for pads 518.

In some embodiments, the grasping portion 514 can be formed from less than three straight portions 520. For example, the grasping portion 514 can be formed from two straight portions 520 connected at a generally v-shaped angle with respect to each other. In some embodiments, the grasping portion can be formed from more than three straight portions 520. For example, the grasping portion 514 can be formed from five straight portions 520 which define the channel 516.

Figure 5B:
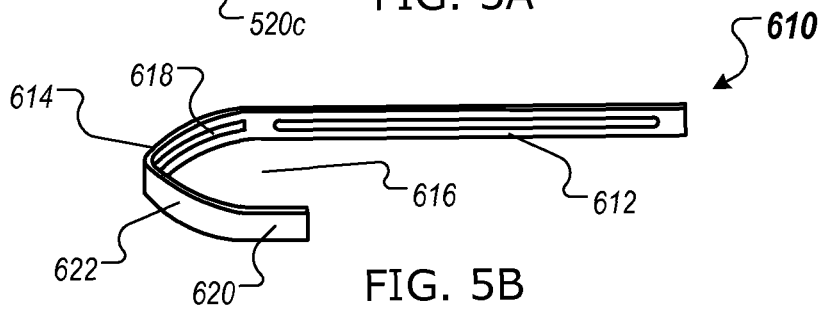

Referring to FIG. 5B, in accordance with some embodiments, a grasping arm 610 includes a longitudinally extending portion 612 and a grasping portion 614. The grasping portion 614 is formed from a straight portion 620 and a generally elliptically shaped portion 622. The generally elliptically shaped portion 622 of the grasping portion 614 defines a channel 616 for receiving an edge of a product, such as a surfboard, snowboard, skateboard, long board, wakeboard, or ironing board. The grasping portion 614 includes one or more pads 618 for receiving the edge of a surfboard or other product as mentioned above. The pads 618 can prevent the grasping portion 614 from damaging a product being secured by the grasping arm 610. In some embodiments, the grasping arm 610 can be made from a soft plastic, such as polypropylene to prevent the grasping portion 614 from damaging a product, thereby eliminating the need for pads 618. In some embodiments, the generally elliptically shaped portion 622 can be formed to match the shape of the edge of a product (e.g. a surfboard) to allow the grasping arm 610 to better contact and secure the product within the channel 616.

Figure 5C:
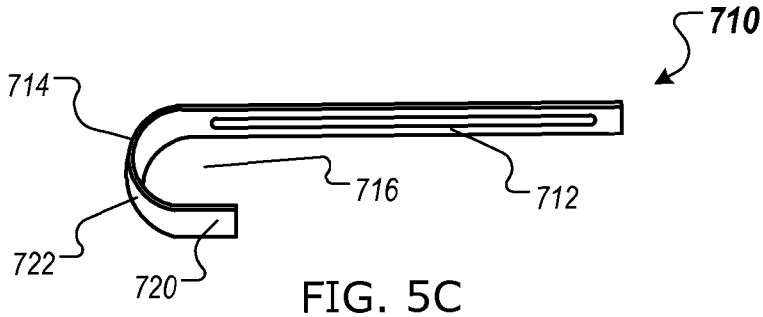

Referring to FIG. 5C, in accordance with some embodiments, a grasping arm 710 includes a longitudinally extending portion 712 and a grasping portion 714. The grasping portion 714 is formed from a straight portion 720 and a generally semi-circular portion 722. The generally semi-circular portion 722 of the grasping portion 714 defines a channel 716 for receiving an edge of a product, such as a surfboard, snowboard, skateboard, long board, wakeboard, or ironing board. In some embodiments, the grasping portion 714 includes one or more pads for receiving the edge of a surfboard or other product as mentioned above. The pads can prevent the grasping portion 714 from damaging a product being secured by the grasping arm 710. In some embodiments, the grasping arm 710 can be made from a soft plastic, such as polypropylene to prevent the grasping portion 714 from damaging a product, thereby eliminating the need for pads. In some embodiments, the generally semi-circular portion 722 can be formed to match the shape of the edge of a product (e.g. a surfboard) to allow the grasping arm 710 to better contact and secure the product.

Figure 5D:
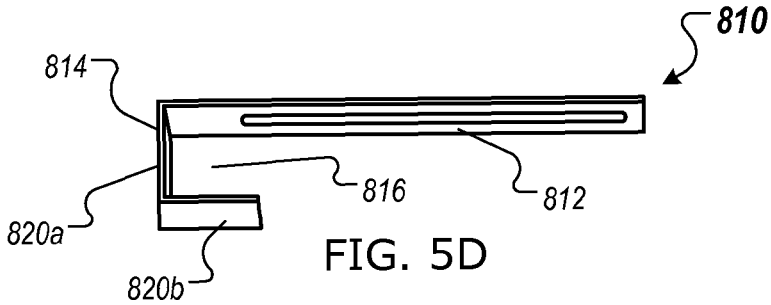

Referring to FIG. 5D, in accordance with some embodiments, a grasping arm 810 includes a longitudinally extending portion 812 and a grasping portion 814. The grasping portion 814 is formed from a plurality of straight portions 820*a-b*. The straight portion 820*a* forms a right angle with respect to the longitudinally extending portion 812 and the straight portion 820*b* forms a right angle with respect to the straight portion 820*a*. The straight portions 820*a-b* of the grasping portion 814, along with the longitudinally extending portion 812, define a channel 816 for receiving an edge of a product, such as a surfboard, snowboard, skateboard, long board, wakeboard, or ironing board. In some embodiments, the grasping portion 814 includes one or more pads for receiving the edge of a surfboard or other product as mentioned above. The pads can prevent the grasping portion 814 from damaging a product being secured by the grasping arm 810. In some embodiments, the grasping arm 810 can be made from a soft plastic, such as polypropylene to prevent the grasping portion 814 from damaging a product, thereby eliminating the need for pads.

In some embodiments, the grasping arm 810 includes a mechanism for adjusting the length of the straight portion 820*a*. For example, the straight portion 820*a* can be formed from two straight pieces that are designed to slide with relation to each other, as described above for the grasping arms 110 with relation to FIG. 1. This allows a user of the grasping arm 810 to adjust the width of the channel 816 by adjusting the distance between the straight portion 820*b* and the longitudinally extending portion 812. The width of the channel 816 can be adjusted to allow the grasping arm 810 to securely grasp a product (e.g. a surfboard) on the front and rear surfaces of the product. By contacting the product on the front and rear surfaces, damage to the edge of the product can be prevented.

Figure 5E:
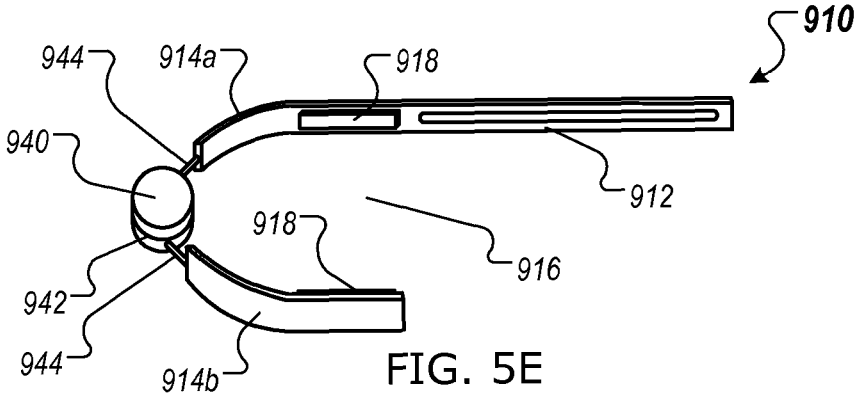

Referring to FIG. 5E, in accordance with some embodiments, a grasping arm 910 includes a longitudinally extending portion 912 and a first grasping portion 914*a* and a second grasping portion 914*b*. The grasping portions are joined by a spring assembly 940. The spring assembly 940 includes a housing 942 for holding a spring mechanism and arms 944 for connecting to the grasping portions 914. The grasping portions 914 define a channel 916 for receiving an edge of a product, such as a surfboard, snowboard, skateboard, long board, wakeboard, or ironing board. In the embodiment depicted, the grasping portions 914 have a generally semi-elliptical shape. In some embodiments, the grasping portions 914 can have shapes similar to those described above with reference to FIGS. 5A-5D. The grasping portions 914 include one or more pads 918 for a surfboard or other product as mentioned above. The pads 918 can prevent the grasping portions 914 from damaging a product being secured by the grasping arm 910. The grasping arm 910 can secure a product (e.g. a surfboard) by receiving an edge of the product within the channel 916. The spring assembly causes the grasping portion 914*b* to rotate towards the grasping portion 914*b* until the pads 918 contact the front and rear surfaces of the product and to securely hold the product in place. By contacting the product on the front and rear surfaces, damage to the edge of the product can be prevented. In some embodiments, the grasping portions 914 can be made from a soft plastic, such as polypropylene to prevent the grasping portions 914 from damaging a product, thereby eliminating the need for pads 918.

Figure 6:
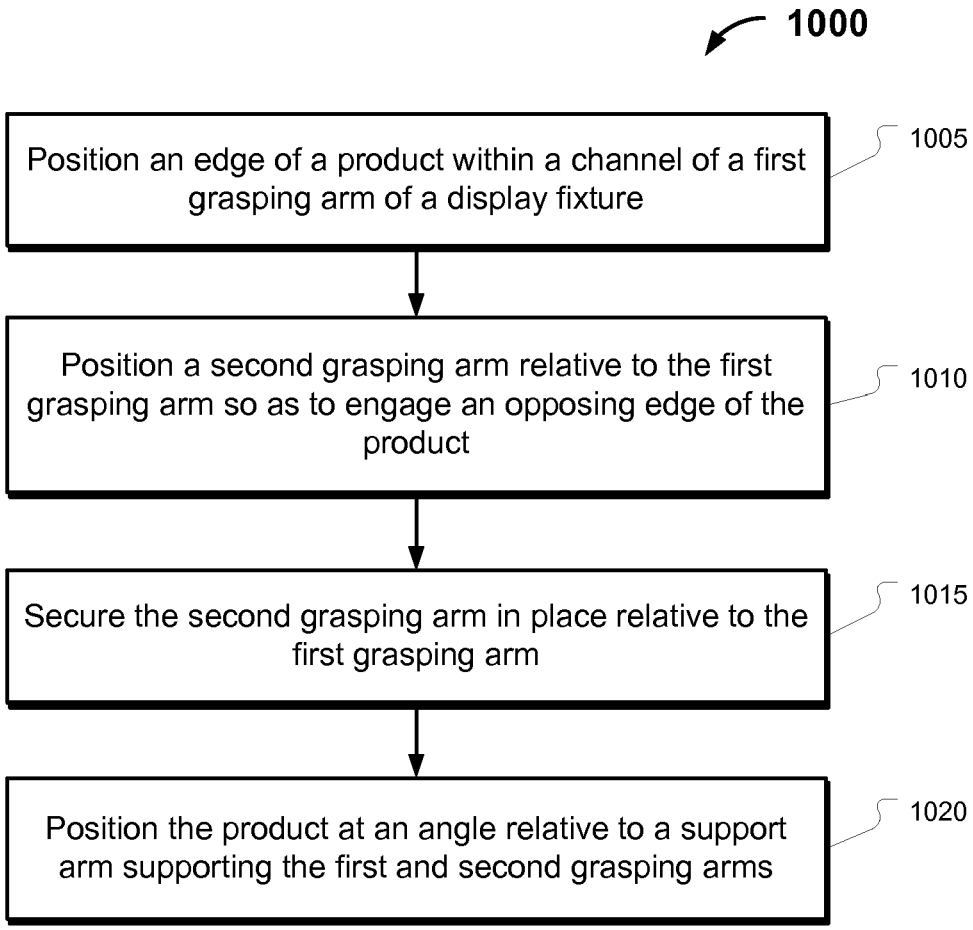
FIG. 6 is a flow chart for a process for securing a product using a display fixture.

Referring now to FIG. 6, some embodiments of a process 1000 for securing a product can include an operation 1005 of positioning an edge of a product within a channel of a first grasping arm of a display fixture. For example, a product such as a surfboard, snowboard, skateboard, long board, wakeboard, or ironing board can be secured by the display fixture 100 shown in FIG. 1 by placing an edge of the product within the channel 116*a* of the grasping arm 110*a*. In some embodiments, positioning an edge of a product includes contacting the edge of the product with one or more pads 118*a* secured to the inner surface of the grasping arm 110*a*.

In some embodiments, positioning an edge of a product within a channel of a first grasping arm of a display fixture can include adjusting the size of the channel by adjusting the length of a straight portion of a non-linear grasping portion of the first grasping arm as described above with reference to FIG. 5D. For example, the straight portion 820*a* of the grasping arm 810 can be formed from two straight pieces that are designed to slide with relation to each other. This allows a user of the grasping arm 810 to adjust the width of the channel 816 by adjusting the distance between the straight portion 820*b* and the longitudinally extending portion 812.

In operation 1010, a user can position a second grasping arm of the display fixture relative to the first grasping arm so as to engage an opposing edge of the product. For example, the grasping arm 110*b* of the display fixture 100 shown in FIG. 1 can be slid relative to the grasping arm 110*a*. The grasping arm 110*b* can be positioned in a horizontal direction by positioning the track 120*b* relative to the bolts 122. The grasping arm 110*b* can be positioned so that an edge of the product, opposite the edge secured by the grasping arm 110*a*, is positioned within the channel 116*b*. In some embodiments, positioning the second grasping arm to engage an opposing edge of the product includes contacting the opposing edge of the product with one or more pads 118*b* secured to the inner surface of the grasping arm 110*b*.

In some embodiments, positioning the second grasping arm relative to the first grasping arm includes passing a portion of the first grasping arm through an aperture or opening in the second grasping arm. For example, the user can position the grasping arm 110*b* relative to the grasping arm 110*a* so that the longitudinally extending portion 112*a* passes through the aperture 124 of the grasping arm 110*b*. For example, if a relatively small product, such as a skateboard, is secured using the display fixture 100, the grasping arm 110*b* may need to be positioned so that the distance between the grasping portion 114*a* and the grasping portion 114*b* is less than the length of the longitudinally extending portion 112*a* in order to properly secure the edges of the skateboard. This can be accomplished by positioning the grasping arm 110*b* so that the longitudinally extending portion 112*a* passes through the aperture 124. In some embodiments, positioning the second grasping arm relative to the first grasping arm includes passing a portion of the second grasping arm through an aperture or opening in the first grasping arm.

In operation 1015, the user can secure the second grasping arm in place relative to the first grasping arm. For example, the user can tighten one or more fasteners in order to secure the second grasping arm to the first grasping arm. As another example, the user can secure the grasping arm 110*b* to the grasping arm 110*a* of the display fixture 100 shown in FIG. 1 by tightening wing nuts secured to the bolts 122 that extend through the tracks 120*a*-*b*. As another example, the second grasping arm can be secured in place relative to the first grasping arm by one or more spring loaded ball bearings attached to the longitudinally extending portion 112*a* engaging with one or more detents in the longitudinally extending portion 112*b*.

In operation 1020, the user can position the product at an angle relative to a support arm supporting the first and second grasping arms. For example, the joint bracket 140 of the display fixture 100 shown in FIG. 1 can be rotated about the bolt 142 so as to position the product being secured by the grasping arms 110 at an angle relative to the support arm 150. In some embodiments, the joint bracket 140 can be secured at the selected angle by the spring loaded pin 152 attached to the support arm 150. The spring loaded pin can pass through an aperture 144 in the joint bracket 140 to secure the joint bracket 140 in place relative to the support arm 150.

A number of embodiments of the invention have been described. Nevertheless, it will be understood that various modifications may be made without departing from the spirit and scope of the invention. Accordingly, other embodiments are within the scope of the following claims.

What is claimed is:

1. A product display apparatus, comprising:

a first bracket member to receive a substantially horizontally extending support;

a substantially horizontal arm extending from the first bracket member and terminating at a distal end;

a second bracket member pivotably coupled to the distal end of the horizontal arm;

an arm assembly coupled to the second bracket member, the arm assembly comprising:

a first arm, having a longitudinally extending portion and a non-linear portion that defines a first channel; and a second arm slidably mated to the first arm, having a longitudinally extending portion, a non-linear portion that defines a second channel opposed to and complementary to the first channel, and an aperture to receive the longitudinally extending portion of the first arm, wherein when the first arm and second arm are slid relative to one another, the longitudinally extending portion of the first arm passes through the aperture; and an adjustment mechanism that permits the arm assembly to rotate about an axis orthogonal to the horizontal arm and holds the arm assembly at one or more predetermined angles relative to the horizontal arm and wherein the first arm and the second arm further comprise non-abrasive members positioned on the non-linear portions for contacting a product to be displayed.

2. The product display apparatus of claim 1, wherein the arm assembly includes means for holding the first arm in a fixed position relative to the second arm.

3. The product display apparatus of claim 1, wherein the first arm further includes one or more apertures disposed within the longitudinally extending portion for receiving a plurality of fastening members and the second arm further includes one or more apertures disposed within the longitudinally extending portion for receiving the plurality of fastening members.

4. The product display apparatus of claim 1, further comprising rotation means to enable a first portion of the horizontal arm to rotate along a major axis of the horizontal arm relative to a second portion of the horizontal arm.

5. The product display apparatus of claim 1, wherein the horizontal arm includes a spring loaded locking member disposed at the distal end and the second bracket member includes apertures for receiving the spring loaded locking member.

6. The product display apparatus of claim 1, wherein the horizontal arm includes a spring loaded member at the distal end that cooperatively engages detents on the second bracket member.

7. The product display apparatus of claim 1, wherein the non-linear portion of the first arm and the non-linear portion of the second arm comprise a plurality of linear sections.

8. The product display apparatus of claim 1, wherein the non-linear portion of the first arm and the non-linear portion of the second arm comprise one or more generally elliptically shaped sections.

9. The product display apparatus of claim 1, wherein the axis is substantially vertical.

10. The product display apparatus of claim 1, wherein the non-linear portion of the first arm and the non-linear portion of the second arm comprise at least two sections rotatably coupled and spring biased relative to one another.

11. The product display apparatus of claim 1, wherein one of the predetermined angles is between about 60 to 75 degrees.

12. A product display system, comprising:

a first product display apparatus including a first frame member to be mounted to a display fixture, a first support arm extending from the first frame member and terminating at a distal end, and a first product support assembly coupled to the distal end of the first support arm, the first product support assembly comprising a first grasping member, including a linear extending portion and an adjacent non-linear portion that defines a first channel, and a second grasping member slidably mated to the first grasping member, including a linear extending portion, an adjacent non-linear portion that defines a second channel substantially opposed to and substantially complementary to the first channel, and an opening to receive the linear extending portion of the first grasping member, wherein when the first grasping member and second grasping member are slid relative to one another, the linear extending portion of the first grasping member passes through the opening, wherein, the first product support assembly is positioned non-orthogonally relative to a major axis of the first support arm; and a second product display apparatus positioned below and in substantial alignment with the first product display apparatus, the second product display apparatus including a second frame member to be mounted to a display fixture, a second support arm extending from the second frame member and terminating at a distal end, and a second product support assembly coupled to the distal end of the second support arm, the second product support assembly comprising a third grasping member, including a linear extending portion and an adjacent non-linear portion that defines a third channel, and a fourth grasping member slidably mated to the first grasping member, including a linear extending portion, an adjacent non-linear portion that defines a fourth channel substantially opposed to and substantially complementary to the third channel, and an opening to receive the linear extending portion of the third grasping member, wherein when the third grasping member and fourth grasping member are slid relative to one another, the linear extending portion of the third grasping member passes through the opening, wherein the second product support assembly is positioned non-orthogonally relative to a major axis of the second support arm;

wherein a first end of an elongated product is retained by the first product display apparatus and a second end of the elongated product is retained by the second product display apparatus.

13. The product display system of claim 12, wherein the first product support assembly is positioned at an angle of about 60 to about 75 degrees relative to the first support arm.

14. The product display system of claim 12, wherein the first grasping member and the second grasping member of the first product display apparatus further comprise non-abrasive resilient members positioned on the non-linear portions for contacting a product to be displayed.

15. The product display system of claim 12, wherein the first product support assembly includes means for holding the first grasping member in a fixed position relative to the second grasping member.

16. The product display system of claim 12, wherein the first grasping member of the first product display apparatus further includes one or more apertures disposed within the linear extending portion for receiving a plurality of fastening members and the second grasping member further includes one ore more apertures disposed within the linear extending portion for receiving the plurality of fastening members.

17. The product display system of claim 12, wherein the non-linear portions of the first, second, third, and fourth grasping members comprise a plurality of linear sections.

18. The product display system of claim 12, wherein the first and second support arms include pivot means to enable the first and second product support assemblies to pivot relative to the first and second support arms respectively.

19. The product display system of claim 12, wherein the non-linear portions of the first, second, third, and fourth grasping members comprise at least two sections rotatably coupled and spring biased relative to one another.

20. A method of securing a product, comprising:

positioning a first product display member relative to a display shelf wherein the first product display member comprises a first bracket member to receive a substantially horizontally extending support of the display shelf, a first support arm extending along a first longitudinal axis from the first bracket member and terminating at a distal end, a first arm assembly including i) a first arm having a longitudinally extending portion and an adjacent non-linear portion and ii) a second arm slidably mated to the first arm, the second arm having a longitudinally extending portion and an adjacent non-linear portion, wherein the first arm assembly is coupled to the first support arm by a first pivot mechanism configured to pivot at an angle relative to the first longitudinal axis;

positioning a second product display member relative to the display shelf at a position spaced apart from the first product display member wherein the second product display member comprises a second bracket member to receive a substantially horizontally extending support of the display shelf, a second support arm extending along a second longitudinal axis from the second bracket member and terminating at a distal end, a second arm assembly which includes i) a first arm having a longitudinally extending portion and an adjacent non-linear portion and ii) a second arm slidably mated to the first arm, the second arm having a longitudinally extending portion and an adjacent non-linear portion, wherein the second arm assembly is coupled to the support arm by a second pivot mechanism configured to pivot at an angle relative to the second longitudinal axis;

pivoting the arm assembly of at least one of the first and second product display members such that the linear portion of one of the first and second arms of the arm assembly forms an acute angle with respect to the longitudinal axis;

releasably securing the pivot member of the at least one of the first and second product display members in a position relative to the support arm of the at least one of the first and second product display members such that the arm assemblies of the first and second product display members are in substantial alignment;

positioning a first end of a product between the first and second arms of a first one of the first and second product display members;

adjusting the arm assembly of the first one of the first and second product display members so that the first and second arms of the arm assembly come in contact with the product;

securing the first and second arms of the first one of the first and second product display members in position relative to each other; and securing a second end of the product with the second one of the first and second product display members.

21. The method of claim 20, wherein the step of adjusting the arm assembly of the first one of the first and second product display members comprises passing the longitudinally extending portion of the first arm of the arm assembly through an opening of the second arm of the arm assembly.

22. The method of claim 20, wherein the acute angle is an angle of about 60 to about 75 degrees.

23. The method of claim 20, wherein the first product display member is positioned generally above the second product display member.

24. The method of claim 20, wherein the step of adjusting the arm assembly of the first one of the first and second product display members comprises loosening at least one fastening member that passes through one or more apertures of the first and second arms of the arm assembly and wherein the step of securing the first and second arms of the first one of the first and second product display members in position relative to each other comprises tightening the fastening member.

* * * * *